US006338653B1

(12) United States Patent
Jones et al.

(10) Patent No.: US 6,338,653 B1
(45) Date of Patent: Jan. 15, 2002

(54) SURFACE MOUNT CABLE CONNECTOR

(75) Inventors: Dennis B. Jones, Orange; Andrew Cheng, Cerritos; Eric Juntwait, Irvine, all of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/611,494

(22) Filed: Jul. 7, 2000

(51) Int. Cl.[7] ..... H01R 9/05
(52) U.S. Cl. ..... 439/579
(58) Field of Search ..... 439/579, 581, 439/98, 394, 610

(56) References Cited

U.S. PATENT DOCUMENTS 5,679,008 A * 10/1997 Takahashi et al. ..... 439/579
5,738,545 A * 4/1998 Igarashi et al. ..... 439/607
6,053,770 A * 4/2000 Blom ..... 439/579
6,056,597 A * 5/2000 Shepherd et al. ..... 439/579

* cited by examiner

*Primary Examiner*—Gary F. Paumen
*Assistant Examiner*—James Harvey
(74) *Attorney, Agent, or Firm*—Wei Te Chung

(57) ABSTRACT

A cable connector for connecting a plurality of coaxial cables to a printed circuit board comprises an insulative housing mounted on a printed circuit board, a plurality of signal terminals, a grounding terminal and a snap cover secured on the housing. The housing defines a plurality of first receiving portions for receiving the coaxial cables. Each signal terminal comprises a solder portion soldered on the printed circuit board and a contact portion extending into the corresponding first receiving portion of the housing. The grounding terminal received in the housing comprises a plurality of solder sections soldered to the printed circuit board and a plurality of tabs extending into the first receiving portions for connecting with metal braids of the coaxial cables, establishing grounding connections. The snap cover defines a plurality of second receiving portions corresponding to the first receiving portions of the housing. The coaxial cables are clamped between the first receiving portions and the second receiving portions thereby pressing conductors of the coaxial cables to contact the contact portion of corresponding signal terminals and preventing displacement of the coaxial cables from the cable connector.

1 Claim, 5 Drawing Sheets

SURFACE MOUNT CABLE CONNECTOR

BACKGROUND OF THE INVENTION

The present invention relates to a connector, and particularly to a cable connector for connecting a plurality of cables to a printed circuit board.

U.S. Pat. No. 5,738,545 discloses a connection device comprising a cable side connector 3 for electrically receiving a flexible cable 7, and a printed board side connector 5 for being soldered to a circuit board (not shown). The cable side connector 3 is adapted to engage with the printed board side connector 5 for electrically connecting the flexible cable 7 to the circuit board. However, the use of the cable side connector 3 complicates manufacturing and increases cost. Hence, an improved electrical connector is required to directly connect a cable to a printed circuit board.

BRIEF SUMMARY OF THE INVENTION

A main object of the present invention is to provide a cable connector for directly interconnecting a plurality of cables with a printed circuit board on which the cable connector is mounted.

A cable connector for connecting a plurality of coaxial cables to a printed circuit board in accordance with the present invention comprises an insulative housing mounted on the printed circuit board, a plurality of signal terminals, a grounding terminal and a snap cover secured on the housing for preventing displacement of the cables from the cable connector.

The housing defines a plurality of first receiving portions for receiving coaxial cables. Each signal terminal comprises a solder portion soldered on the printed circuit board and a contact portion extending into a corresponding first receiving portion of the housing. The grounding terminal received in the housing comprises a plurality of solder sections soldered to the printed circuit board and a plurality of tabs extending into the first receiving portions for connecting with metal braids of the coaxial cables. The snap cover defines a plurality of second receiving portions corresponding to the first receiving portions of the housing. The coaxial cables are clamped between the first receiving portions and the second receiving portions thereby pressing conductors thereof to contact the contact portions of the signal terminals and preventing displacement of the coaxial cables from the cable connector.

Other objects, advantages and novel features of the invention will become more apparent from the following detailed description of the present embodiment when taken in conjunction with the accompanying drawings.

DETAILED DESCRIPTION OF THE INVENTION

Figure 1:
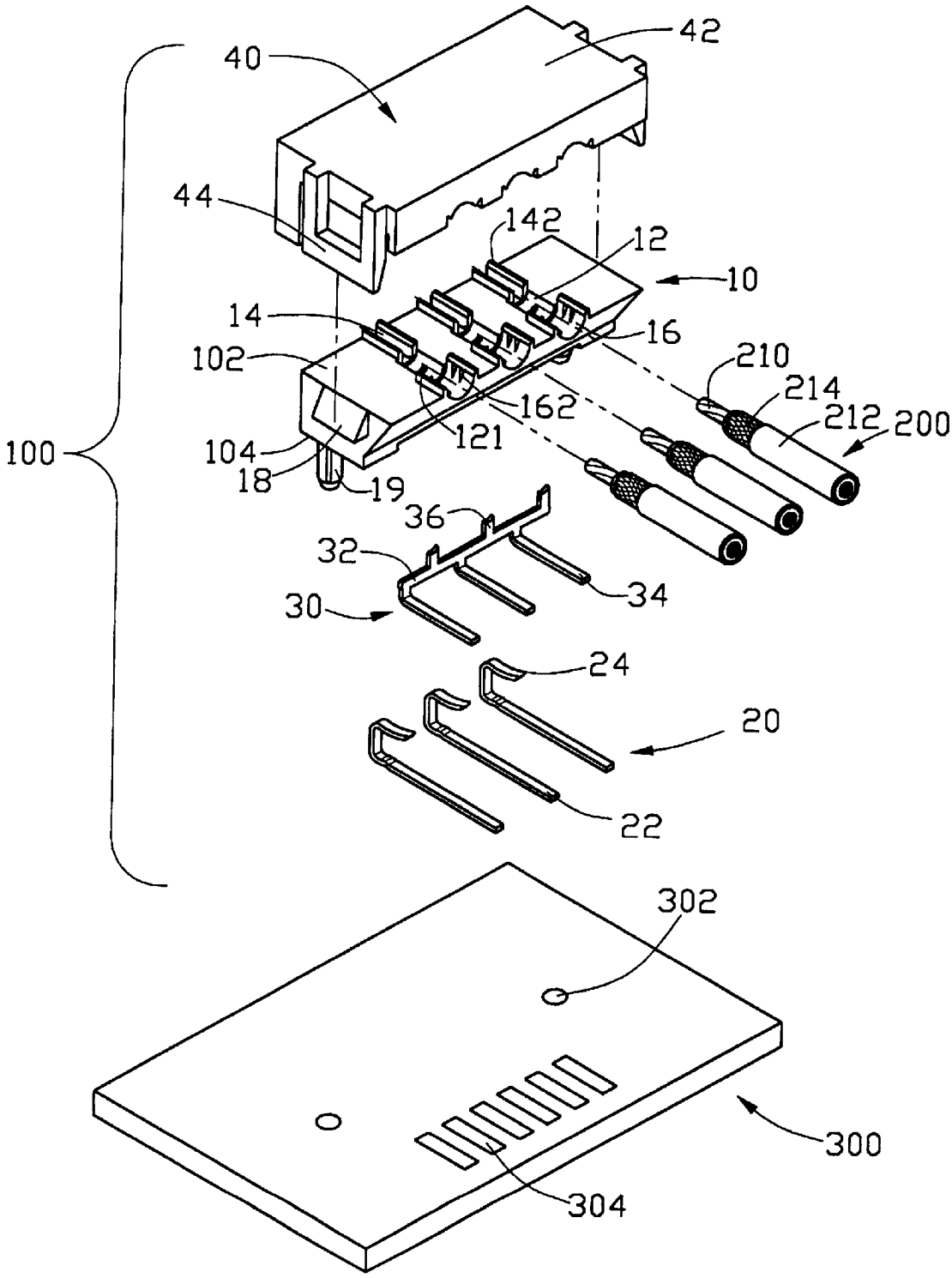
FIG. 1 is an exploded view of a cable connector of the present invention, a plurality of coaxial cables to be terminated by the cable connector, and a printed circuit board for mounting the cable connector thereto.

Referring to FIG. 1, a cable connector 100 of the present invention for connecting a plurality of coaxial cables 200 to a printed circuit board 300 comprises an elongate insulative housing 10, a plurality of signal terminals 20, a grounding terminal 30, and an elongate snap cover 40.

The housing 10 comprises a mating surface 102, and a mounting surface 104 opposite the mating surface 102. A plurality of first receiving portions 12 is provided on the mating surface 102 for receiving the coaxial cables 200. Each first receiving portion 12 comprises a front clamping portion 14 having a pair of opposite clamping arms 142 extending upwards, and a rear first strain relief 16. A plurality of protrusions 162 is formed on an inner face (not labeled) of each first strain relief 16 for engaging with a corresponding cable 200. A recess 121 is defined in a middle portion of each first receiving portion 12 between the clamping portion 14 and the first strain relief 16 and extends toward the mounting surface 104 of the housing 10. As is clearly shown in FIG. 3, a slot 13 is defined in the mounting surface 104 of the housing 10 and communicates with the recesses 121. A pair of wedges 18 is formed on opposite ends of the housing 10 for engaging with the snap cover 40. A pair of posts 19 extends downwardly from the mounting surface 104 of the housing 10 for fitting into the printed circuit board 300.

Each signal terminal 20 comprises a solder portion 22 at one end thereof for being soldered to the circuit board 300 and a contact portion 24 at another end.

The grounding terminal 30 comprises an elongate beam 32. A plurality of solder sections 34 extends downwardly and then rearwardly from the beam 32 for being soldered to the circuit board 300. A plurality of tabs 36 extends upwardly from the beam 32 and alternates with the solder sections 34.

Figure 2:
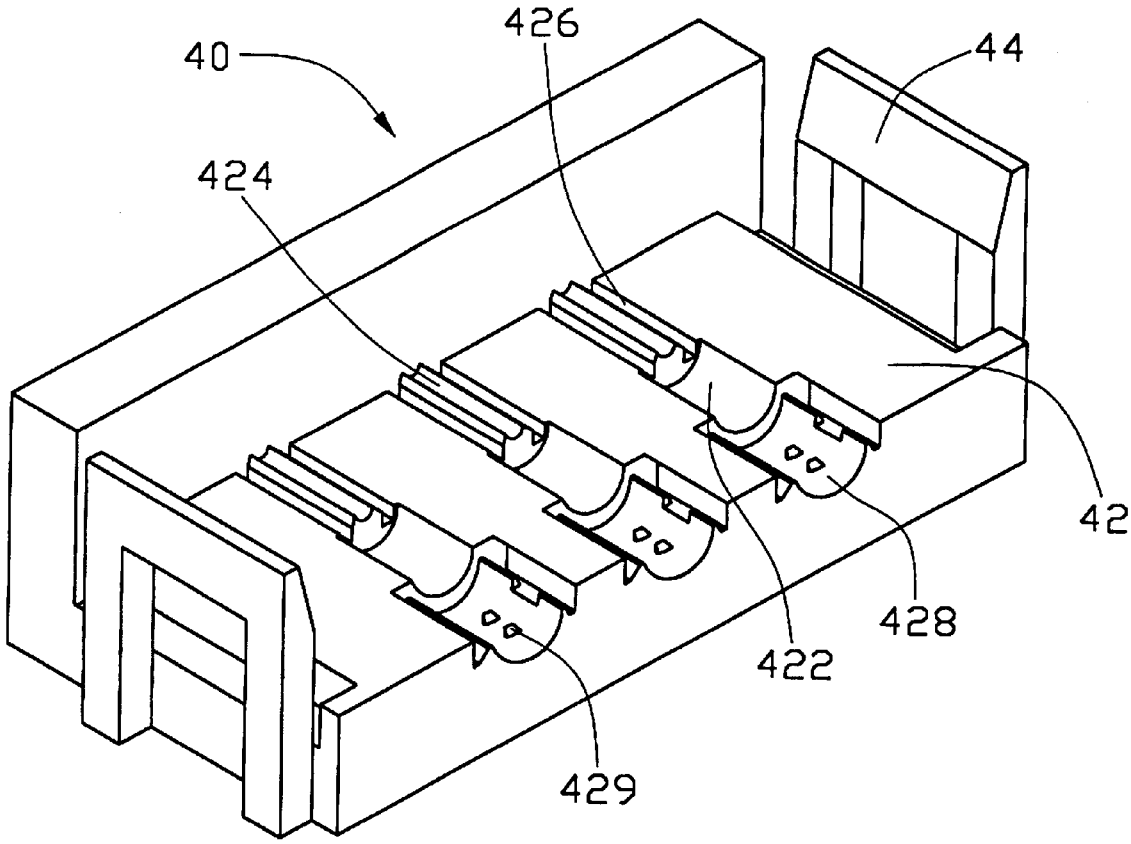
FIG. 2 is a bottom perspective view of a snap cover of the cable connector of FIG. 1.

Referring to FIG. 2, the elongate snap cover 40 comprises a base 42 and a pair of buckles 44 formed on opposite ends thereof. The base 42 defines a plurality of second receiving portions 422 corresponding to the first receiving portions 12 of the housing 10. Each second receiving portion 422 comprises a block 424 formed at one end thereof corresponding to the clamping portion 14 of the housing 10 and a second strain relief 428 defined in the other end thereof corresponding to the first strain relief 16 of the housing 10. A pair of grooves 426 is defined at opposite sides of the block 424. A plurality of protrusions 429 is formed on a bottom surface (not labeled) of the second strain relief 428 for securing a cable jacket 212 of the coaxial cable 200.

Figure 3:
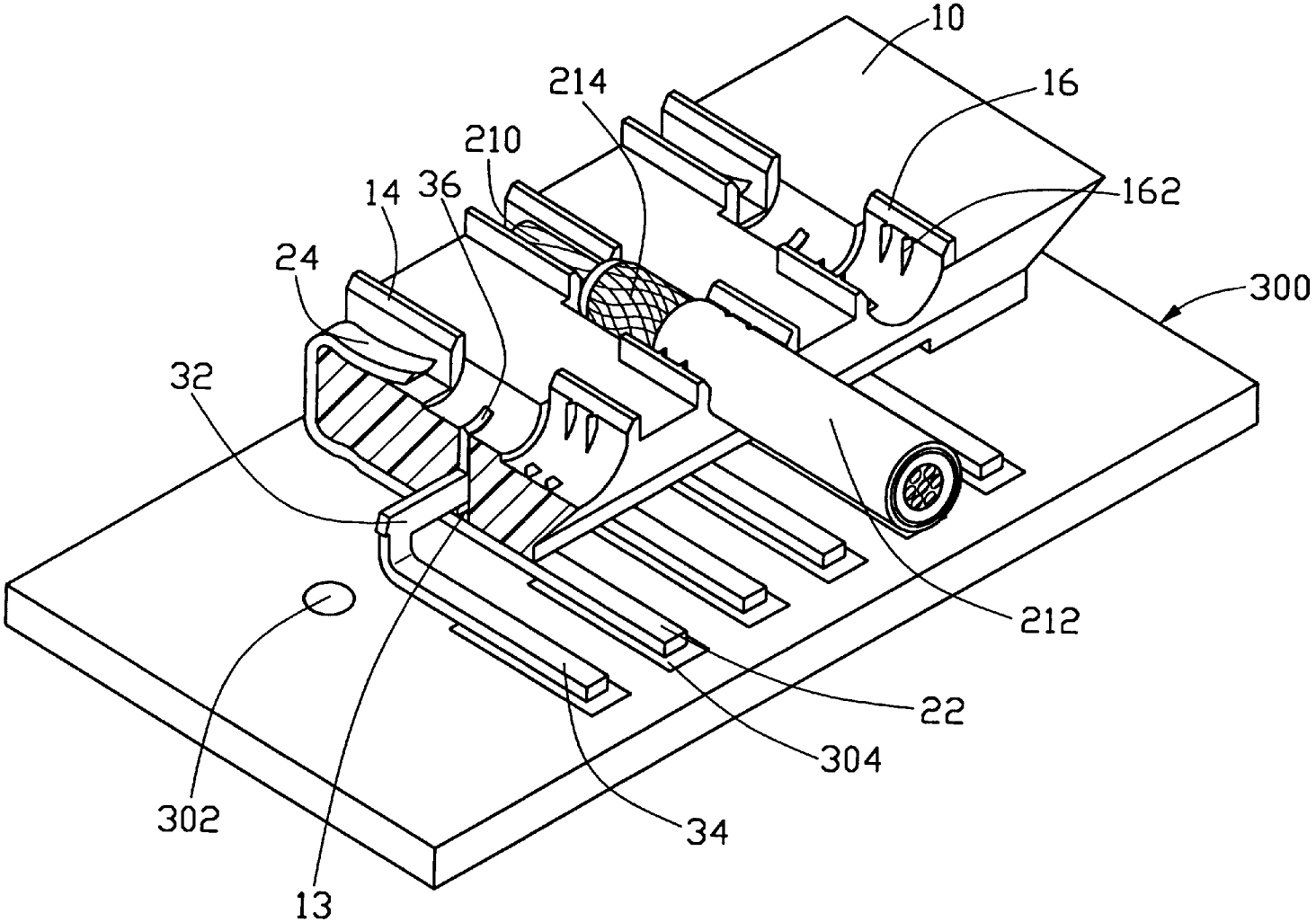
FIG. 3 is a perspective view of an insulative housing of the cable connector of FIG. 1 mounted on the printed circuit board, the housing being partially cut away to illustrate the relationship between signal terminals, a grounding terminal and the housing.
Figure 4:
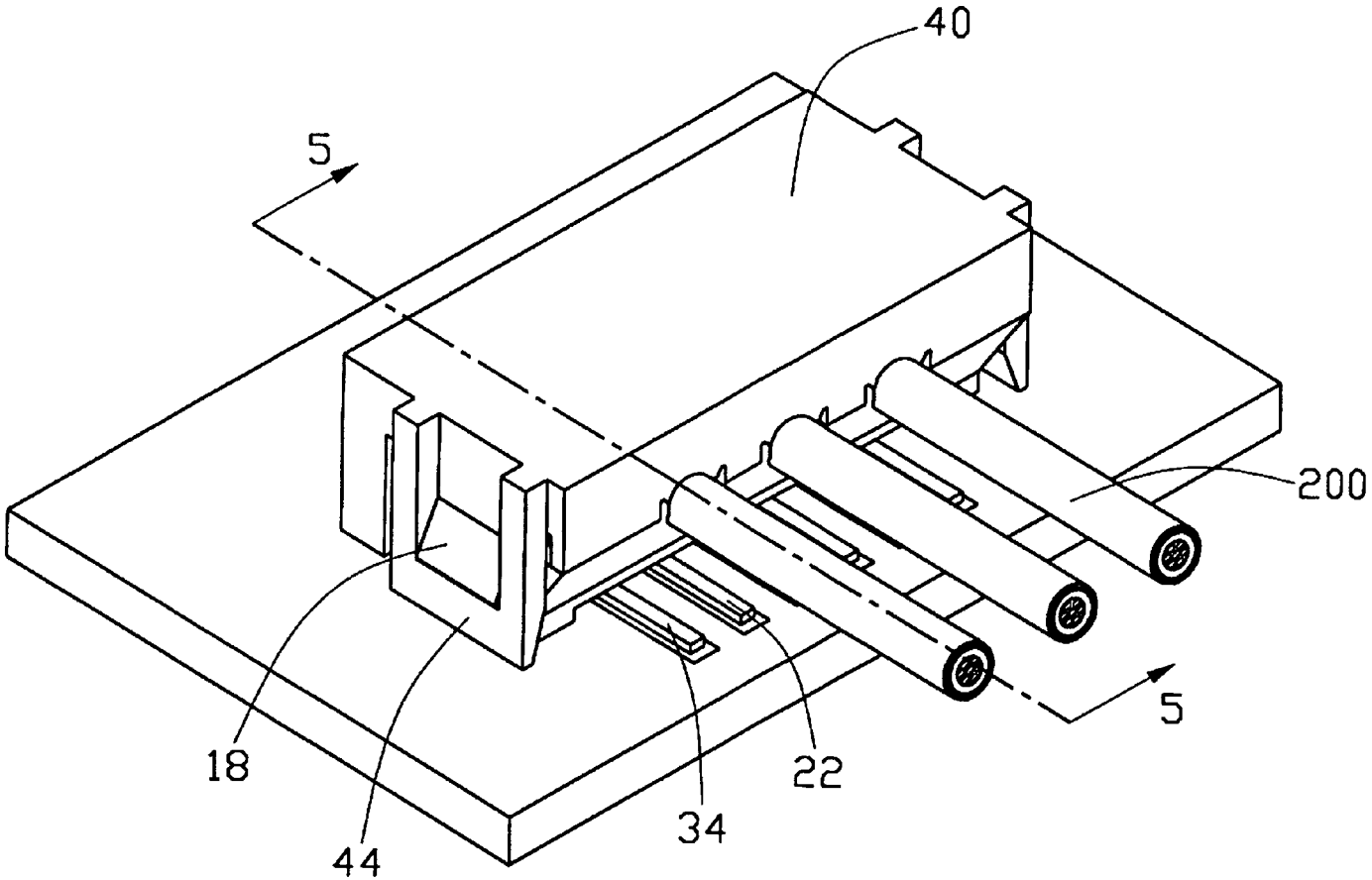
FIG. 4 is an assembled view of FIG. 1.
Figure 5:
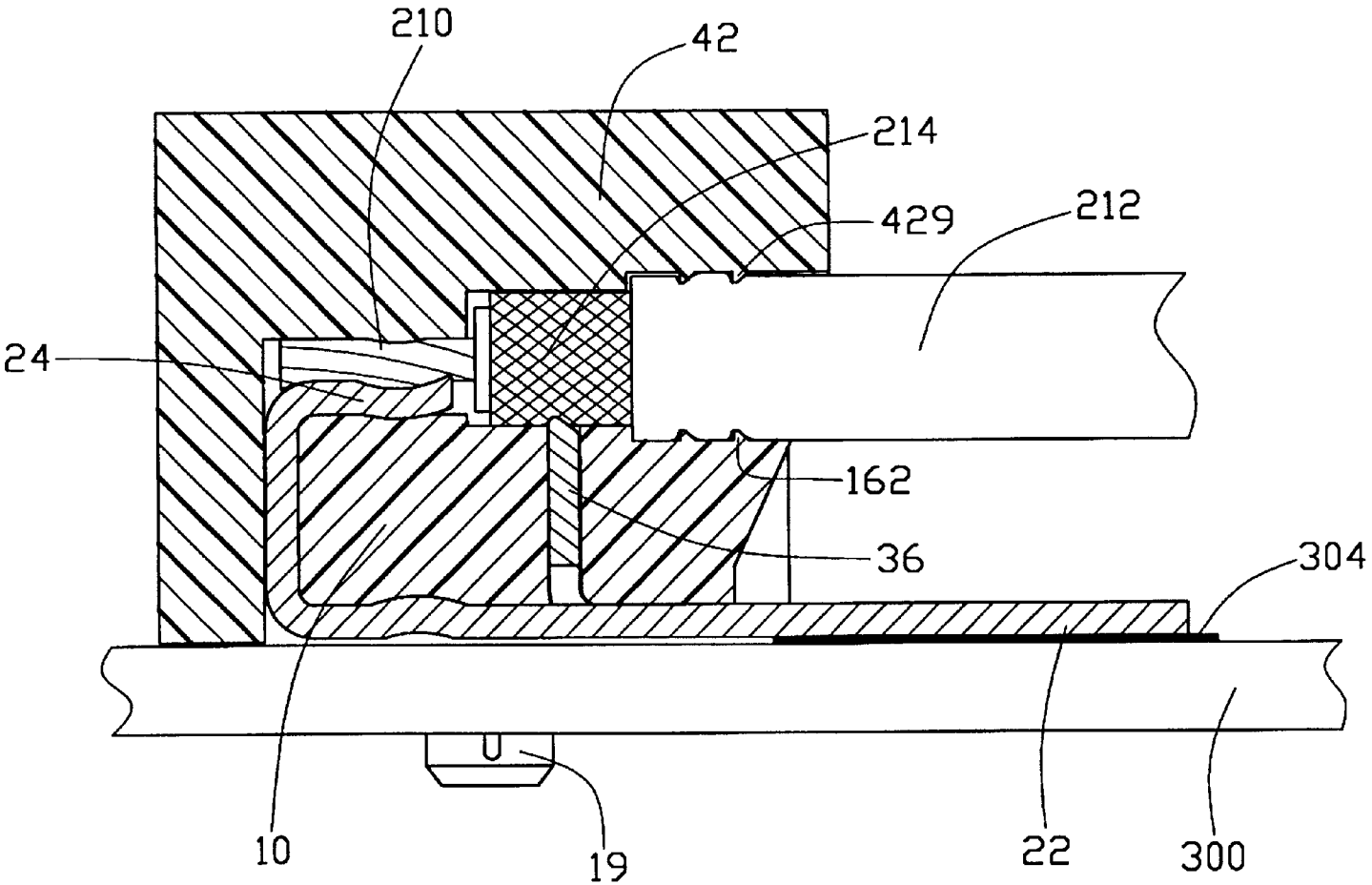
FIG. 5 is a cross-sectional view taken along line 5—5 of FIG. 4.

Referring to FIGS. 3, 4 and 5, in assembly, the beam 32 of the grounding terminal 30 is inserted into the slot 13 of the housing 10 with the tabs 36 extending into the recesses 121 and the solder sections 34 downwardly exposed. The signal terminals 20 are then assembled to the housing 10 with the contact portions 24 thereof being received in the clamping portions 14 respectively, and the solder portions 22 alternating with the solder sections 34 of the grounding terminal 30. Each contact portion 24 and each tab 36 received in the same first receiving portion 12 are aligned with each other. The posts 19 of the housing 10 are then pressed into a pair of through holes 302 of the printed circuit board 300. The solder sections 34 of the grounding terminal 30 and the solder portions 22 of the signal terminals 20 are soldered to solder pads 304 of the printed circuit board 300. The coaxial cables 200 are inserted into the first receiving portions 12 of the housing 10 whereby a conductor 210 of each coaxial cable 200 is received in a corresponding clamping portion 14, a metal braid 214 thereof contacts the corresponding tab 36 of the grounding terminal 30 to provide a grounding connection, and the cable jacket 212 thereof is received in the corresponding first stain relief 16.

Finally the snap cover 40 is assembled to the housing 10 by snugly fitting the wedges 18 of the housing 10 with the buckles 44 of the snap cover 40. When the snap cover 40 and the housing 10 are assembled together, the clamping arms 142 of the housing 10 enter into the corresponding grooves 426 of the snap cover 40, the blocks 424 of the snap cover 40 enter into corresponding spaces between the clamping arms 142 of the housing 10 to press conductors 210 to electrically engage with the contact portions 24 of the corresponding signal terminals 20, and the first strain reliefs 16 and the corresponding second strain reliefs 428 cooperatively clamp the corresponding cable jackets 212 therebetween with the protrusions 162, 429 thereof biting into the cable jackets 212 to prevent displacement of the coaxial cables 200 from the cable connector 100. An electrical connection between the conductor 210 of each coaxial cable 200 and the printed circuit board 300 and a grounding connection between the metal braid 214 of each coaxial cable 200 and the printed circuit board 300 are thus established.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector for connecting a plurality of cables to a printed circuit board, each cable having a conductor and a metal braid around the conductor, comprising:

an insulative housing having a mounting surface for mounting on the printed circuit board and a mating surface opposite the mounting surface, the housing defining a plurality of first receiving portions recessed from the mating surface for clamping the cables;

a plurality of signal terminals each having a solder portion for soldering to the printed circuit board and a contact portion extending into a corresponding first receiving portion of the housing;

a grounding terminal received in the housing and comprising a plurality of solder sections for soldering to the printed circuit board and a plurality of tabs, each tab extending into a corresponding first receiving portion for connecting with the metal braid of a corresponding cable; and a snap cover connected to the housing and comprising a base, the base defining a plurality of second receiving portions corresponding to the first receiving portions of the housing for correspondingly clamping the coaxial cables therebetween, thereby pressing the conductor of each cable to contact the contact portion of the corresponding signal terminal, and pressing the metal braids to engage with the corresponding tabs of the grounding terminal, and preventing displacement of the cables from the cable connector;

wherein each of the first receiving portions comprises a clamping portion at a first end thereof, said clamping portion having a pair of clamping arms, and each of the second receiving portions comprises a block, each of the contact portions extending into a corresponding clamping portion and between the clamping arms thereof, each block projecting into a corresponding clamping portion for pressing the conductor of a corresponding cable to contact the contact portion of a corresponding signal terminal;

wherein each of the first receiving portions comprises a first strain relief at a second end thereof, a plurality of protrusions being defined on the corresponding first strain relief, and each of the second receiving portions comprises a second strain relief corresponding to the first strain relief, a plurality of protrusions being defined on the corresponding second strain relief, and wherein each first strain relief with the protrusions and each second strain relief with the protrusions together clamp the corresponding cable there between for preventing displacement of the cable;

wherein the housing defines a slot from the mounting surface, and the grounding terminal further comprises a beam connecting with the solder sections and the bats, the beam is received in the slot of the housing;

wherein a recess is defined from each of the first receiving portions in communication with the slot and the tabs of the grounding terminal extend into the recesses, respectively, for contacting the metal braids of the cables;

wherein the housing forms a pair of wedges on opposite ends thereof, the snap cover further comprises a pair of buckles on opposite ends of the base and the wedges engage with the buckles thereby securing the snap cover on the housing.

* * * * *